United States Patent [19]

Konrath et al.

[11] Patent Number: 4,913,115

[45] Date of Patent: Apr. 3, 1990

[54] FUEL INJECTION PUMP FOR INTERNAL COMBUSTION ENGINES, ESPECIALLY DIESEL ENGINES

[75] Inventors: Karl Konrath, Freiberg/Neckar; Claus Koester, Ditzingen; Manfred Schwarz, Gerlingen; Klaus Krieger, Affalterbach; Helmut Tschoeke, Ostfildern; Ulrich Stratemeier, Oberriexingen, all of Fed. Rep. of Germany

[73] Assignee: Robert Bosch GmbH, Stuttgart, Fed. Rep. of Germany

[21] Appl. No.: 334,425

[22] Filed: Apr. 7, 1989

[30] Foreign Application Priority Data

Jun. 1, 1988 [DE] Fed. Rep. of Germany ..... 3818574

[51] Int. Cl.[4] ..... F02M 39/00

[52] U.S. Cl. ..... 123/373; 123/372; 123/370

[58] Field of Search ..... 123/365, 373, 364, 368, 123/370, 371, 372, 449

[56] References Cited

U.S. PATENT DOCUMENTS

| | | | |
|---|---|---|---|
| 3,659,570 | 5/1972 | Yoshino | 123/373 |
| 3,759,236 | 9/1973 | Staudt | 123/373 |
| 3,923,026 | 12/1975 | Hoki | 123/372 |
| 4,095,574 | 6/1978 | Yoshino | 123/373 |
| 4,286,558 | 9/1981 | Djordjevic | 123/371 |
| 4,305,362 | 12/1981 | Schwartz | 123/372 |
| 4,567,870 | 2/1986 | Tumber | 123/370 |
| 4,664,079 | 5/1987 | Sakuranaka | 123/370 |
| 4,706,627 | 11/1987 | Eltze | 123/370 |
| 4,802,451 | 2/1989 | Takahashi | 123/373 |

*Primary Examiner*—Carl Stuart Miller

*Attorney, Agent, or Firm*—Edwin E. Greigg

[57] ABSTRACT

When motor vehicles are driven, discontinuities that lead to load spikes arise between overrunning and running under load. The load spikes are avoided by means of a discontinuous increase in fuel quantity, which makes it possible for the engine to come gently to rest in its suspension, to bypass the drive play, and to convert the changes in increased fuel quantity without bucking. By incorporating drag elements into the connection between the arbitrary actuation of an intermediate lever, which affects the fuel injection quantity, and an idling stop, a discontinuous adjustment of the intermediate lever is attained.

21 Claims, 2 Drawing Sheets

FUEL INJECTION PUMP FOR INTERNAL COMBUSTION ENGINES, ESPECIALLY DIESEL ENGINES

BACKGROUND OF THE INVENTION

The invention is based on a fuel injection pump for internal combustion engines such as for Diesel engines. An essential disadvantage of motor vehicles equipped with Diesel engines is the bucking of the vehicle at the onset of acceleration. To reduce this vehicle bucking, fuel injection pumps are additionally provided with damping devices; in hard acceleration, these devices allow a change in the fuel injection quantity effected by the fuel injection pump to occur only after a delay.

In a fuel injection pump of this type (German Offenlegungsschrift No. 37 41 638), U.S. Ser. No. 280,864 filed Dec. 7, 1988, now U.S. Pat. No. 4,884,542 the damping device is adjustable in such a manner that except at relatively high rpm, at which vehicle bucking is no longer a major factor because of the high kinetic energy of the vibrating masses, the metering of fuel over the rpm is effected at individually definable rates. Thus, the actuation of the damping device via the adjustment of the adjusting lever in the previously defined range is directly associated with an adjustment of the fuel quantity supplied. This situation hinders buck-free vehicle operation especially when the vehicle changes from overrunning to running under load.

OBJECT AND SUMMARY OF THE INVENTION

The fuel injection pump according to the invention has a advantage that the onset of acceleration causes the fuel injection pump to react with a predetermined change in fuel injection, which is followed by a segment of time in which the fuel increase is interrupted.

As a result, the engine, which because of the acceleration and the associated change in the required torque tilts to the side about its longitudinal axis, is capable of resting gently in its suspension, by means of resilient engine mounts. Consequently, the existing system-specific drive play that occurs between overrunning and running under load can be exploited without increasing the fuel quantity and torque; after that, the injection quantity, now varying again, can be converted into acceleration without causing bucking.

The fuel injection pump according to the invention has various advantages. Among them, springs of a lever arrangement by way of which the indicated fuel quantity relationship is effected are adapted such that upon adjustment of the lever arrangement in the performance graph of fuel quantity over adjustment travel of the adjusting lever, the fuel quantity takes a linear course at intervals, and looping of the characteristic curve does not occur.

The invention will be better understood and further objects and advantages thereof will become more apparent from the ensuing detailed description of preferred embodiments taken in co junction with the drawings.

DESCRIPTION OF THE PREFERRED EMBODIMENTS

Figure 1:
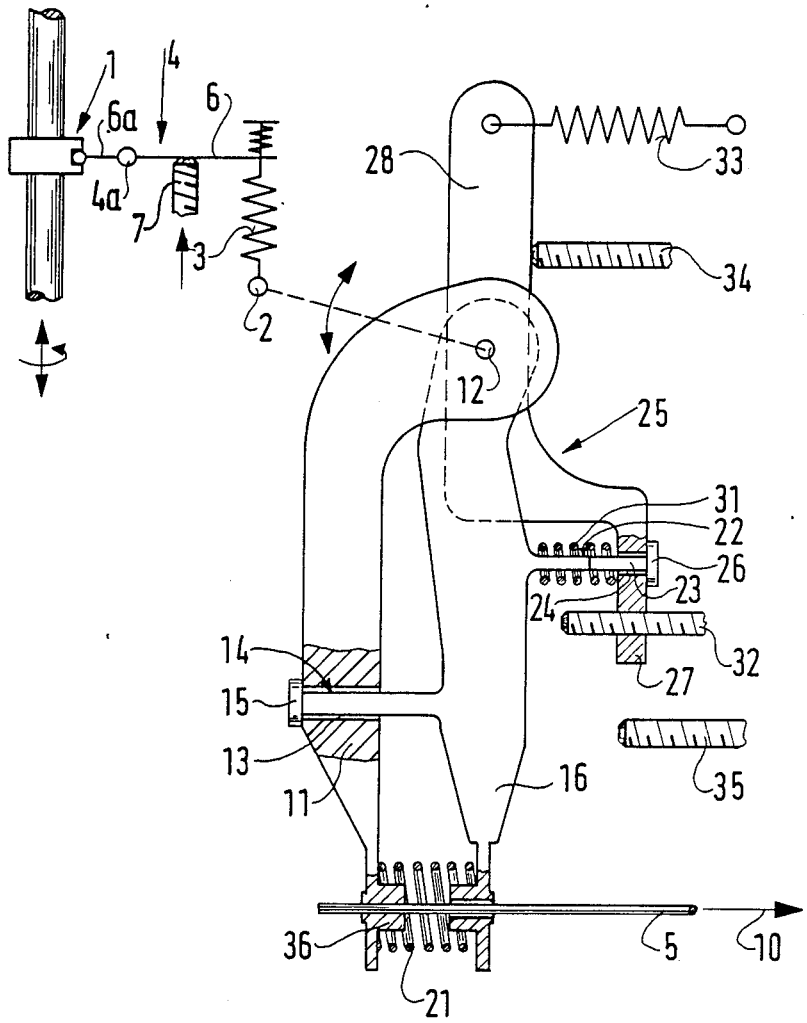
FIG. 1 is a schematic plan view of an adjusting lever arrangement in a first exemplary embodiment.

In FIG. 1, an adjusting lever arrangement is shown for actuating a fuel injection quantity adjusting device 1 of a fuel injection pump of the distributor type (not shown) relative to a well known piston which is both rotated and reciprocated by an engine driven cam of a well known type as shown by the arrows. The adjusting lever arrangement is pivoted in the direction of the arrow 10 by a Bowden cable 5, which transmits the adjustment desired by the vehicle driver. The Bowden cable 5 is joined to the end of a one-armed adjusting lever 11 that is pivotable about a pin 12. In its middle portion, the adjusting lever 11 has an opening 13, the extension of which is oriented at a tangent to the pivoting motion of the adjusting lever 11 about the pin and is penetrated by a spacer stop 14, the free end of the stop has a head 15 the extension of which is larger than the cross section of the opening 13 in the plane at right angles to the opening 13.

The end of the space stop 14 remote from the head 15 is secured to or integral with a one-armed intermediate lever 16, which is mounted firmly on the pin 12 and is rotatable with the pin 12. This pin 12 is connected to a governor of the fuel injection pump, preferably to a adjusting device of the support point 2 of a governor spring 3, by way of which the fuel quantity adjusting device 1 is controlled.

The fuel quantity adjusting device is adjustable by a two-armed governor lever 4, having arms 6 and **6*a* in which the lever 4 is pivotable about a pin at 4*a*. The arm 6 is engaged by the governor spring 3 counter to the force of an rpm transducer 7 and the arm 6*a* is pivotably connected to the quantity adjusting device. A prestressed first coupling spring 21 is supported between one end of the intermediate lever 16 and one end of the adjusting lever 11, which is provided with a proximity stop 36 oriented toward the intermediate lever 16. In addition to the spacer stop 14, the intermediate lever 16 also has a further spacer stop 22 which is oriented in the opposite direction from the space stop 14 and operates relative to two-armed drag lever 25 which is pivotable about pin 12 and has arms 27 and 28**.

With its shaft 23, the spacer stop 22 passes through an opening 24 of arm 27 of the two-armed drag lever 25. The shaft 23 has a head 26 on its end remote from the intermediate lever 16; the extension of this head in the plane oriented at right angles to the shaft 23, is larger than the cross section of the opening 24. Between the arm 27 of the drag lever 25 and the intermediate lever 16 is a prestressed second coupling spring 31, which is guided on the shaft 23 of the spacer stop 22. In the arm 27, the drag lever 25 has an adjustable proximity stop 32, which is oriented counter to the intermediate lever 16. The other arm 28 of the drag lever 26 is engaged by a restoring spring 33, which causes the drag lever 25 to contact a stationary, adjustable idling stop 34. An adjustable full-load stop 35 is also attached in stationary fashion, in such a way that it can come into contact with the intermediate lever 16.

The device described above functions as follows:

If the engine, beginning in the idling state, requires torque, and the Bowden cable 5 adjusts in the direction of the arrow 10 toward an increased fuel quantity, then the adjusting lever 11 connected to the Bowden cable 5 follows this motion, by pivoting about the pin 12. In a first motion segment of the pivoting of the adjusting lever 11, the intermediate lever 16, which is kept spaced apart from the adjusting lever 11 by the prestressed first coupling spring 21 by a distance defined by the contact of the stop head 15 on the adjusting lever 11, follows, until the second coupling spring 31, which has a lesser prestressing than the first coupling spring 21, has run through its operating range with the impact of the intermediate lever 16 on the proximity stop 32. The drag lever 25 is kept in contact with the idling stop 34 because of the restoring spring 33 which is prestressed more strongly than the first coupling spring 21, and so initially remains there, in its outset position.

In a second motion segment, further depression of the gas pedal by motion in the same direction as the motion of the Bowden cable 5 as indicated in FIG. 1 leads to further rotation of the adjusting lever 11 about the pin 12; but this motion can no longer be transmitted to the intermediate lever 16, because of the lesser prestressing of the first coupling spring 21 by comparison to the greater prestressing of the restoring spring 33. The relative motion of the adjusting lever 11 with respect to the intermediate lever 16 ends, upon contact of the adjusting lever 11 with the intermediate lever 16, via the proximity stop 36, once the operating range of the first coupling spring 21 has been run through.

In a third motion segment, further deflection of the Bowden cable 5 in the direction of gas pedal depression leads to a continued rotation of the adjusting lever 11 and to renewed rotation of the intermediate lever 16, which has come into contact with the adjusting lever stop 36 and in turn, via the proximity stop 32 which it reached at the end of the first motion segment, transmits the motion on to the drag lever 25 which pivots counter to the force of the restoring spring, until the intermediate lever 16 strikes the full-load stop 35.

The overall result is a coupled rotation of the intermediate lever 16 upon deflection of the adjusting lever 11 via the Bowden cable 5 in the direction of the arrow 10, during the first motion segment; a standstill on the part of the intermediate lever 16 during the second motion segment; and a coupled rotation of the intermediate lever 16 once again during the third motion segment.

The above described functional sequence results in the following sequence of action: Via the pin 12 that is firmly joined to the intermediate lever 16, rotations of the intermediate lever 16 lead to an adjustment of the one support point 2 of the governor spring 3 and hence to the adjustment of the fuel injection quantity adjusting device 1, while during rotations of the adjusting lever 11 and of the drag lever 25, the pin 12 serves merely as a pivot support; no direct rotational coupling of the pin 12 takes place and the described action can take place only indirectly, via th coupling to the intermediate lever 16.

The increase in the fuel injection quantity until the end of the first motion segment is only just great enough to make the engine, in response to the resultant acceleration and the attendant change in torque demanded, tilt to the side far enough about its longitudinal axis that it can come gently into contact with the resilient buffers of its suspension (engine mounts).

The time for this contact is made available to the engine during the second motion segment, during which the intermediate lever 16 does not follow the motion of the adjusting lever 11, and no increased fuel quantity reaches the engine.

In this contact position, the engine is capable of passing the increased fuel quantity, supplied to it during the third motion segment, on to the next gear stage without bucking, and thus to bypass the drive play that occur between overrunning and running under load.

Figure 2:
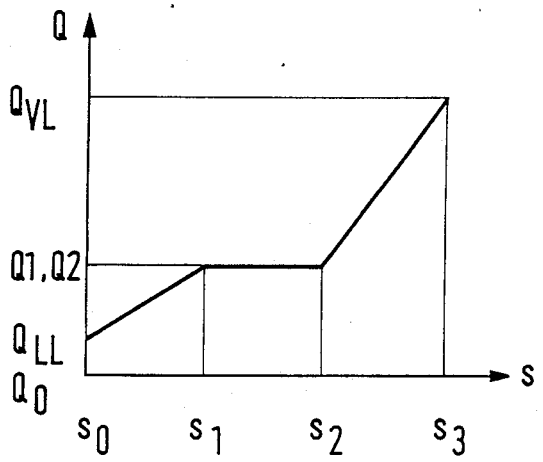
FIG. 2 is a diagram plotting the fuel quantity Q over the adjusting travel s of the adjusting lever and FIG. 3 shows a second exemplary embodiment.

In FIG. 2, the course of action is represented in a diagram, in which the fuel quantity Q is plotted over the adjusting travel s of the adjusting lever 11.

During the first motion segment, the travel segment $s_0$ to $s_1$ is traversed, which is associated with the rise in fuel quantity from $Q_{LL}$ to $Q_1$; $Q_{LL}$ stands for the fuel quantity during idling.

In the second motion segment, no increase in fuel quantity takes place over the travel segment $s_1$ to $s_2$; thus $Q_1 = Q_2$. The third motion segment, in the travel segment $s_2$ to $s_3$, produces a rise in fuel quantity from $Q_2$ to $Q_{VL}$; $Q_{VL}$ represents the fuel quantity at full load.

It will be understood that the fuel quantity courses described can be modified, and that a plurality of drag levers and coupling springs can be used, to attain a plurality of gradations in the rise in fuel quantity upon actuation of the adjusting lever. Nor do the pivot support points for the adjusting lever and the drag lever or levers have to coincide with the pin 12. Modified adjusting characteristics can also be attained via a different kind of support of the levers.

The definitive factor is that the course of the fuel quantity, in the diagram of the fuel quantity Q over the adjustment travel s of the adjusting lever 11 has segments without, or with at least greatly reduced, changes in quantity, which make it possible for the engine to gently contact its suspension, to bypass the drive play, and to convert fuel quantity changes without bucking.

Figure 3:
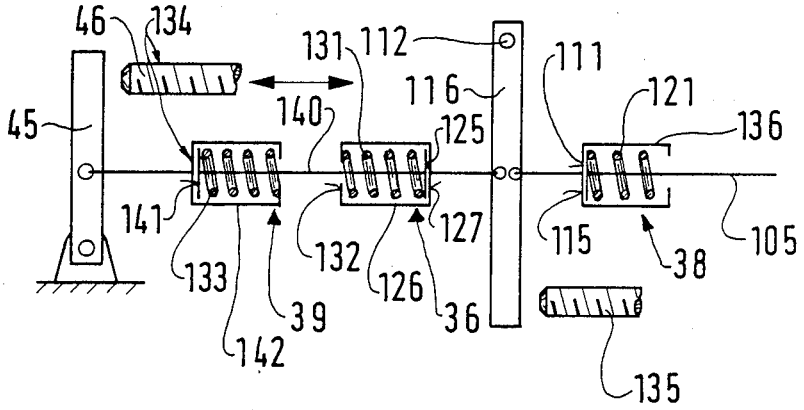

The above-described exemplary embodiment with levers is also attainable, however, with drag levers. In the arrangement shown in FIG. 3, elements equivalent to those of FIG. 1 are identified by the same reference numeral, increased by 100. Once again, an intermediate lever 116 is provided, which is actuatable about the pin 112 to adjust the fuel injection quantity. In the connection of the Bowden cable 105 with the intermediate lever 116, however, a spring capsule 38 embodied as a drag lever is used. The spring plate 111 located in the spring capsule, and between which and the housing 136 coupling spring 121 in the form of a compression spring is fastened, is equivalent to the adjusting lever 11 of FIG. 1. The stops provided between the adjusting lever 11 and the intermediate lever 16 of FIG. 1 are realized here by the face end 115 of the housing 136 of the spring capsule 38. The drag lever 25 is also realized in the form of a spring capsule 36. Once again, the drag lever 25 is the equivalent of a spring plate 125 of a coupling spring 131, which is equivalent to the coupling spring 31 of FIG. 1 and is fastened between the spring plate 125 and the housing 126 of the spring capsule 36. The housing, in turn, with its end faces, furnishes the proximity stop 132 and the spacer stop 127. The spring plate 125 in an extension of the function of the drag lever 25 of FIG. 1, is connected via a connecting bar 140 to a spring plate 141, and a restoring spring 133 is fastened between the spring plate 141 and an adjustable housing 142. This arrangement may likewise be embodied as a spring capsule 39, in which case the housing, in the form of an adjustable idling stop 134, is optionally adjustable via an intermediate lever 45 and an adjusting element 46. The pivoting motion of the intermediate lever 116 is again limited by a full-load stop 135.

Upon actuation of the Bowden cable 105, given suitably matched springs, first the coupling spring 131 is compressed, since the prestressing of the restoring spring 133 and coupling spring 121 are greater. If the coupling spring 131 meets a barrier, or the spring plate meets a corresponding stop, then the second coupling spring 121 is consequently compressed; in this second motion segment, the intermediate lever 116 remains at a standstill in the position it had previously attained. Only once the spring plate 111 has moved the coupling spring 121 against a barrier or has reached a stop can the intermediate lever 116 be moved again, in that the restoring spring 133 is compressed until such time as the intermediate lever 116 comes to rest on the full-load stop 135. The restoring spring 133, in this case accommodated in the spring capsule 39, may instead be connected to the spring plate 125 in some other way, for instance in the form of a tension spring with an adjustable stop additionally attached to the bar 140. In this modification the support point 2 rotates with the pin 112 as the intermediate lever 116 moves in order to adjust the quantity adjusting device 1.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States:

1. A fuel injection pump for internal combustion engines, having a pump piston that draws fuel from a fuel-filled pump interior that is at feed pressure and pumps it at high pressure to injection nozzles of the engine, which comprises a quantity adjusting device adjustable by a governor relative to the pump piston which determines the fuel injection quantity pumped per pump piston stroke, said governor being coupled to an intermediate lever (16), a spacer stop (14) on said intermediate lever (16), an arbitrarily actuatable adjusting element (11), a prestressed first coupling spring (21) positioned between said intermediate lever and said adjusting element (11) which forces said adjusting element into contact with said spacer stop (14) on the intermediate lever (16), at least one drag element, said adjusting element (11) coupled via said intermediate lever (16) with said at least one drag element (25) by mean of said prestressed first coupling spring and a prestressed second coupling spring (31); an idling stop (34), said at least one drag element (25) holdable on said idling stop (34) by a prestressed restoring spring (33); and said adjusting element (11), said intermediate lever (16) and said at least one drag element (25) movable relative to one another and holdable by means of said first and second prestressed coupling springs (21, 31) on spacer stops (14, 22) which define spacings of said element relative to one another; and the proximity of these elements relative to one another definable by means of proximity stops (32, 36).

2. A fuel injection pump as defined by claim 1, in which said spacer stops (14, 22) and a proximity stop (32) are adjustable.

3. A fuel injection pump as defined by claim 1, in which prestressing of the springs (21, 31, 33) is adjustable.

4. A fuel injection pump as defined by claim 2, in which prestressing of the springs (21, 31, 33) is adjustable.

5. A fuel injection pump as defined by claim 3, in which said adjusting element (11) is adjustable by means of a suitable selection of the spring prestressing of said first and second coupling springs (21, 31) and restoring spring (33) said second coupling spring yields inward only after an inward yielding of said first coupling spring, which inward yielding is ended by contact of the corresponding element with a proximity stop.

6. A fuel injection pump as defined by claim 4, in which said adjusting element (11) is adjustable by means of a suitable selection of the spring prestressing of said first and second coupling springs (21 31) and restoring spring (33), said second coupling spring yields inward only after an inward yielding of said first coupling spring, which inward yielding is ended by contact of the corresponding element with a proximity stop.

7. A fuel injection pump as defined by claim 1, in which only a single drag element (25) is provided.

8. A fuel injection pump as defined by claim 7, in which a prestressing of the restoring spring (33) is greater than that of the first coupling spring (21) between the adjusting element (11) and the intermediate lever (16), and the prestressing of the first coupling spring (21) is greater than the prestressing of the second coupling spring (31) between the intermediate lever (16) and the drag element (25).

9. A fuel injection pump as defined by claim 1, in which said adjusting element (11), and said at least one drag element (25) are pivotable about a pin (12) firmly joined to said intermediate lever (16), with which pin the intermediate lever (16) is coupled to the quantity adjusting device via the governor.

10. A fuel injection pump as defined by claim 2, in which said adjusting element (11), and said at least one drag element (25) are pivotable about a pin (12) firmly joined to said intermediate lever (16), with which pin the intermediate lever (16) is coupled to the quantity adjusting device via the governor.

11. A fuel injection pump as defined by claim 3, in which said adjusting element (11), and said at least one drag element (25) are pivotable about a pin (12) firmly joined to said intermediate lever (16), with which pin the intermediate lever (16) is coupled to the quantity adjusting device via the governor.

12. A fuel injection pump as defined by claim 5, in which said adjusting element (11), and said at least one drag element (25) are pivotable about a pin (12) firmly joined to said intermediate lever (16), with which pin the intermediate lever (16) is coupled to the quantity adjusting device via the governor.

13. A fuel injection pump as defined by claim 8, in which said adjusting element (11), and said at least one drag element (25) are pivotable about a pin (12) firmly joined to said intermediate lever (16) with which pin the intermediate lever (16) is coupled to the quantity adjusting device via the governor.

14. A fuel injection pump as defined by claim 1, which includes a full-load stop (35) that limits the travel of said adjusting element (11) counter to the force of the restoring spring (33).

15. A fuel injection pump as defined by claim 2, which includes a full-load stop (35) that limits the travel of said adjusting element (11) counter to the force of the restoring spring (33).

16. A fuel injection pump as defined by claim 3, which includes a full-load stop (35) that limits the travel of said adjusting element (11) counter to the force of the restoring spring (33).

17. A fuel injection pump as defined by claim 5, which includes a full-load stop (35) that limits the travel of said adjusting element (11) counter to the force of the restoring spring (33).

18. A fuel injection pump as defined by claim 8, which includes a full-load stop (35) that limits the travel of said adjusting element (11) counter to the force of the restoring spring (33).

19. A fuel injection pump as defined by claim 9, which includes a full-load stop (35) that limits the travel of said adjusting element (11) counter to the force of the restoring spring (33)

20. A fuel injection pump as defined by claim 14, in which said intermediate lever (16) comes to rest on said full-load stop (35).

21. A fuel injection pump as defined by claim 1, in which said adjusting element said at least one drag element, as well as said coupling springs and stops associated therewith are parts of a spring capsule equipped as a drag element, which is inserted into a connection between an actuating device, for arbitrary actuation of said intermediate lever (16), and a connection between the intermediate lever and an adjustable idling stop.

* * * * *